US005288013A

United States Patent [19]

Sellors

[11] Patent Number: 5,288,013

[45] Date of Patent: Feb. 22, 1994

[54] CARTON WITH PARTIAL END PANELS

[75] Inventor: Thomas J. Sellors, Winthrop Harbor, Ill.

[73] Assignee: Olympic Packaging, Inc., Mundelein, Ill.

[21] Appl. No.: 838

[22] Filed: Jan. 5, 1993

[51] Int. Cl.[5] ..... B65D 5/24

[52] U.S. Cl. ..... 229/161; 229/186

[58] Field of Search ..... 229/40, 161, 164, 186

[56] References Cited

U.S. PATENT DOCUMENTS

| | | | |
|---|---|---|---|
| Re. 32,956 | 6/1989 | Schuster . | |
| 2,591,500 | 4/1952 | Bloomer | 229/161 |
| 2,723,027 | 11/1955 | Guyer . | |
| 3,157,309 | 11/1964 | Chidsey, Jr. et al. . | |
| 3,203,584 | 8/1965 | Forrer . | |
| 3,291,366 | 12/1966 | Nemoede et al. | 229/161 |
| 3,314,585 | 4/1967 | Forrer | 229/161 X |
| 3,347,447 | 10/1967 | Bates | 229/161 |
| 3,377,016 | 4/1968 | Bates | 229/161 |
| 3,557,633 | 1/1971 | Ketler | 229/164 |
| 3,935,989 | 2/1976 | Naylor | 229/161 |
| 4,582,199 | 4/1986 | Schuster . | |
| 4,726,511 | 2/1988 | Addiego | 229/161 |
| 4,895,296 | 1/1990 | Trauschke | 229/40 |

*Primary Examiner*—Gary E. Elkins
*Assistant Examiner*—Christopher McDonald
*Attorney, Agent, or Firm*—Foley & Lardner

[57] ABSTRACT

A carton for use with a plurality of primary packages or containers, such as juice cartons, includes a generally rectangular bottom panel, side panels and top panels to provide for sealing of the carton. The carton is prepared from a rectangular blank and a pair of partial end panels are formed from the material of the bottom panel and tuck flaps at the lower edge of the opposite ends of the respective side panels. The carton yields substantial board savings when compared to prior art containers. Method for assembly of the carton are also disclosed.

7 Claims, 4 Drawing Sheets

CARTON WITH PARTIAL END PANELS

BACKGROUND OF THE INVENTION

1. Field of the Invention

The present invention relates generally to the art of folding cartons or other secondary packages used for containing one or a plurality of articles. More specifically, a preferred form of the present invention relates to a carton which is designed to contain a plurality of primary packages, e.g., those having rectangular or square horizontal cross-sections. In its most preferred embodiment, the present invention relates to a folding carton for containing a plurality of individual beverage packages, such as those commonly used for juice drinks.

2. Description of the Prior Art

Individual serving beverage products which are individually packaged and wrapped for sanitation purposes are very popular. They are formed with a rectangular base and side walls and are typically packaged with a straw which is inserted through a small, foil covered opening to allow access to the contents. These modern containers provide numerous advantages over cans, bottles and the like because they may be packaged in a more efficient way for shipping, storage and display. The products have a long shelf life and may be sold in packs of three, four, six, eight, nine and twelve or more individual packages.

A number of relatively common folding carton features can be added to secondary packages for such products, such as tear strips, handles and the like. One carton which is currently being used for such products is described in U.S. Pat. No. 4,852,199 issued Apr. 15, 1986 to Schuster for "Carton and Blank Therefor" and its corresponding Reissue Pat. Re. 32,956 issued Jun. 20, 1989. The preferred carton shown in this patent includes a tear strip and/or a handle. The production blank includes a generally rectangular main blank portion with partial end panels extending from the sides thereof. The end panels include tuck flaps and score lines which are offset from the bottom score lines to insure that when the end panels are raised to a position where they are perpendicular to the base, the end panels will be bowed slightly inward, thereby facilitating fill on the machinery used to insert the primary packages. The tuck flaps that are part of the blank which extend beyond the rectangular central portion are formed with a tuck score line which does not extend at a 45 degree angle with respect to the hinge score lines of the tuck flap area.

A large number of prior art patents are referenced in the aforementioned Schuster reissue patent, some of which art is identified in the information disclosure statement accompanying this specification. Most relate to beverage containers for bottles and the like and, in many instances, the end containment for the beverage primary container includes partial top and/or bottom panels which are formed integrally with the base and extend outwardly therefrom. For example, the "Article Carrier" shown in U.S. Pat. No. 3,203,584 issued Aug. 31, 1965 to Forrer shows a carton for holding six beverage cans and which includes a bottom seal. More importantly for purposes of this specification, the carrier includes cut-outs for the cans to assist in holding them vertically when the package is lifted with thumb and finger holes. The carrier also includes partial end flaps extending down from the top and made from board which extends beyond the generally rectangular center section of the carrier. Almost the reverse situation is shown in U.S. Pat. No. 3,157,309 issued Nov. 17, 1964 to Chidsey, et al. for "Carrier Carton for Cylindrical Articles" where the package is designed to contain six bottles and cut-outs are provided at the top. The bottom of this carton includes partial end panels and tuck flaps which, again, extend outwardly from the main portion of the blank.

In some of the prior art references, top and bottom panels are provided for the ends and in numerous instances full closure is provided. In that regard, see Guyer, U.S. Pat. No. 2,723,027 issued Nov. 8, 1955 for "Carton Handle".

Several issues now face carton designers and, in fact, the designers of all types of packaging. With an increased focus on the environmental "friendliness" of all types of packaging, whether paper, plastic or other materials, the amount of packaging material used to perform a specific job becomes increasingly important. The amount of material affects not only the environmental friendliness of the resulting product, but also perceptions of the consumer about that issue. Important to the manufacturers of the packaging and their customers is the cost of the product, which in many cases is directly related to the amount of board required to produce the carton. Also of considerable importance is the ease with which the carton can be filled and closed in automated, high-speed equipment.

A carton which would be easy to fabricate, easy to assemble, fill and close, and which would consume less board would be a significantly improved product representing a substantial advance in this art.

SUMMARY OF THE INVENTION

The present invention features a carton and a blank therefor which achieve the several beneficial advantages of reduced board consumption, ease of manufacture and ease of assembly and fill.

The present invention, in its preferred embodiment, is a folding carton and a blank therefor, the blank being generally rectangular and including a unique arrangement of conventional and easy to form components such as hinge score lines, cut lines and tuck flap scores. More specifically, the present invention features a carton in which opposite ends of the bottom panel and adjacent lower portions of the adjoining side panels together form partial end panels. Containment is provided, even though the contents may not be fully supported by the bottom of the carton. In its most preferred form, the present invention is a folding carton which is prepared from a rectangular blank having, in order, a partial-width top panel, a first side panel, a bottom panel, a second side panel, and a full-width top closure panel. The respective panels are joined by hinge score lines conventional in the folding carton art. Parallel cut lines are formed inwardly from the sides of the rectangular blank extending entirely across the bottom panel and partially into each side panel, and the lower portion of each side panel, outside the cut lines, include a tuck flap score line extending from the end of the cut to the nearest corner of the side panel and end panel. The carton is assembled by twisting the inner edge of the several bottom panels to a vertical position as the side panels are moved perpendicularly to the bottom panel, thus providing vertical, partial end panels for the articles to be packaged. The tuck flaps are adhered and the top closure panels are then folded parallel to the partial bottom panel and sealed by any suitable technique such as adhesive, tape or the like. Other ways in which the present invention satisfies the desirable goals set forth in the background section of the specification will become apparent to those skilled in the art after the specification has been read and understood. Such other ways are deemed to fall within the scope of the present invention if they fall within the scope of the claims which follow.

DESCRIPTION OF THE DRAWINGS

In the various FIGURES, like reference numerals are used to denote like components.

DETAILED DESCRIPTION OF THE PREFERRED EMBODIMENT

Before proceeding to a detailed description of the most preferred embodiment of the present invention, several comments are warranted regarding the applicability and scope thereof. First, while the invention is illustrated as a folding carton and the blank is illustrated as being folding carton stock, the invention is applicable to other types of packaging material, such as corrugated sheets. Corrugated could be used, for example, for larger items or for packaging a plurality of the final packages prepared according to the present invention after they are filled with product.

Figure 5:
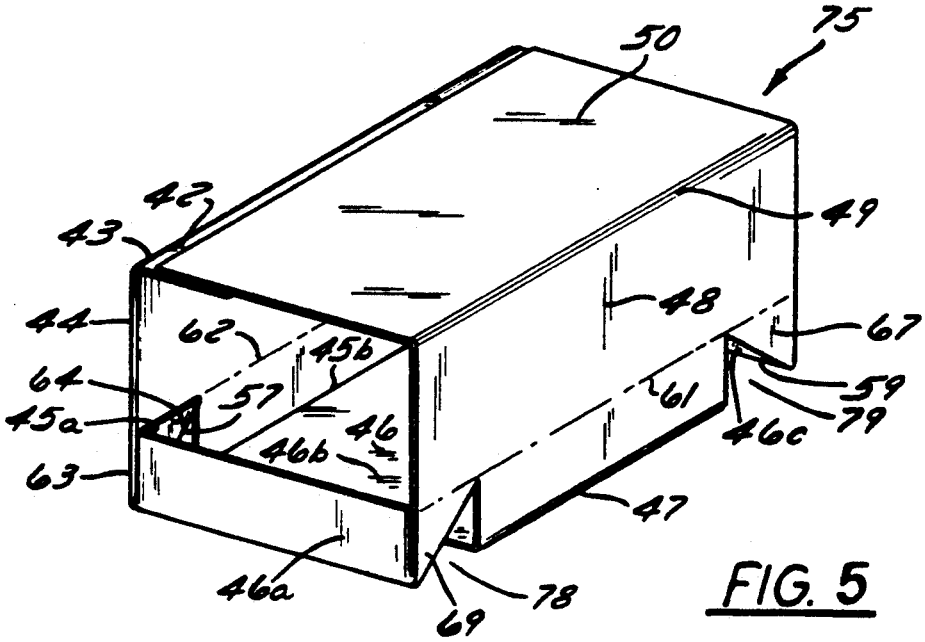
FIG. 5 is a perspective view of the completed carton of the present invention without primary packaging therein.

In addition, one particular size carton is illustrated, but one skilled in this art will readily appreciate that the dimensions could be widely varied to accommodate different size primary packages. This would apply to the height, width and length, to accommodate any number of primary packages. The only requirement with regard to dimensions is that the cut lines to be described later will form partial end panels which are narrower than one dimension of the product to be packaged. The resulting openings at the bottom of the carton (to be illustrated in FIGS. 5-6) must not allow the packages to fall from the carton. Furthermore, while the present invention is illustrated as being most suitable for packages which have rectangular or square horizontal cross-sections, the principles of the invention are applicable to cartons for other shaped products. For example, cans could be contained within the carton of the present invention without modifying the basic principles to be described later. Bottles could likewise be packaged, with modifications to the upper portions of the carton such as those shown in the prior art referred to earlier herein. Moreover, it will be appreciated that the method of assembly is preferred and not limited, since folds can be made by automated packaging equipment in sequences different than that illustrated for the preferred embodiment, all as will be appreciated by one skilled in the art.

Figure 1:
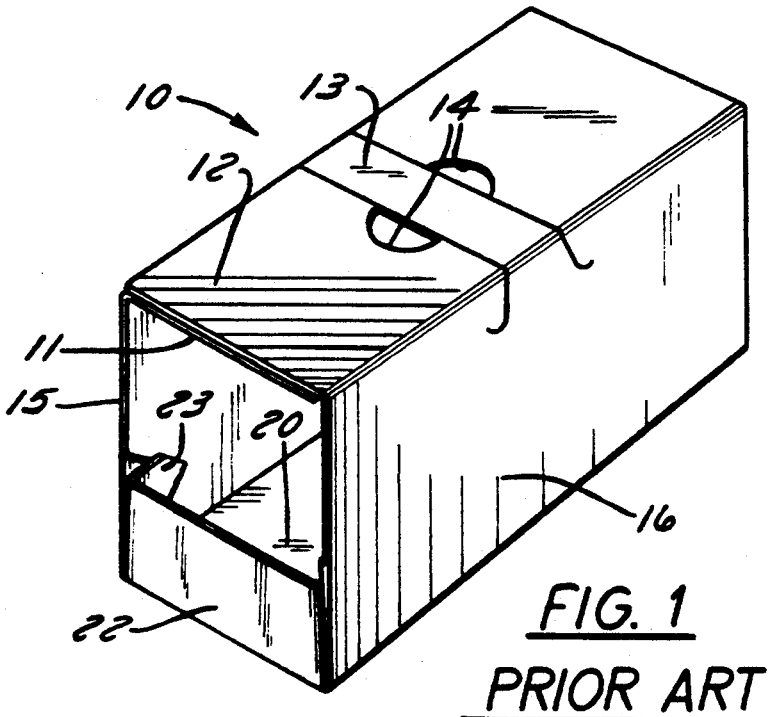
FIG. 1 PRIOR ART
FIG. 1 is a perspective view of the carton shown in the aforementioned Schuster patent, representing one type of prior art carton.

Proceeding now to a description of the preferred embodiment of the present invention, the carton and blank will best be appreciated when compared to a product currently in use, namely the product illustrated in the Schuster patent mentioned previously. FIG. 1 shows in perspective view a carton 10 in an assembled, unfilled condition having top closure panels 11 and 12, handle 13, finger openings 14 and side walls 15 and 16. The bottom is shown at 20 and it should be understood that the bottom is continuous, i.e., equal in dimensions to top panels 11 and 12.

Figure 2:
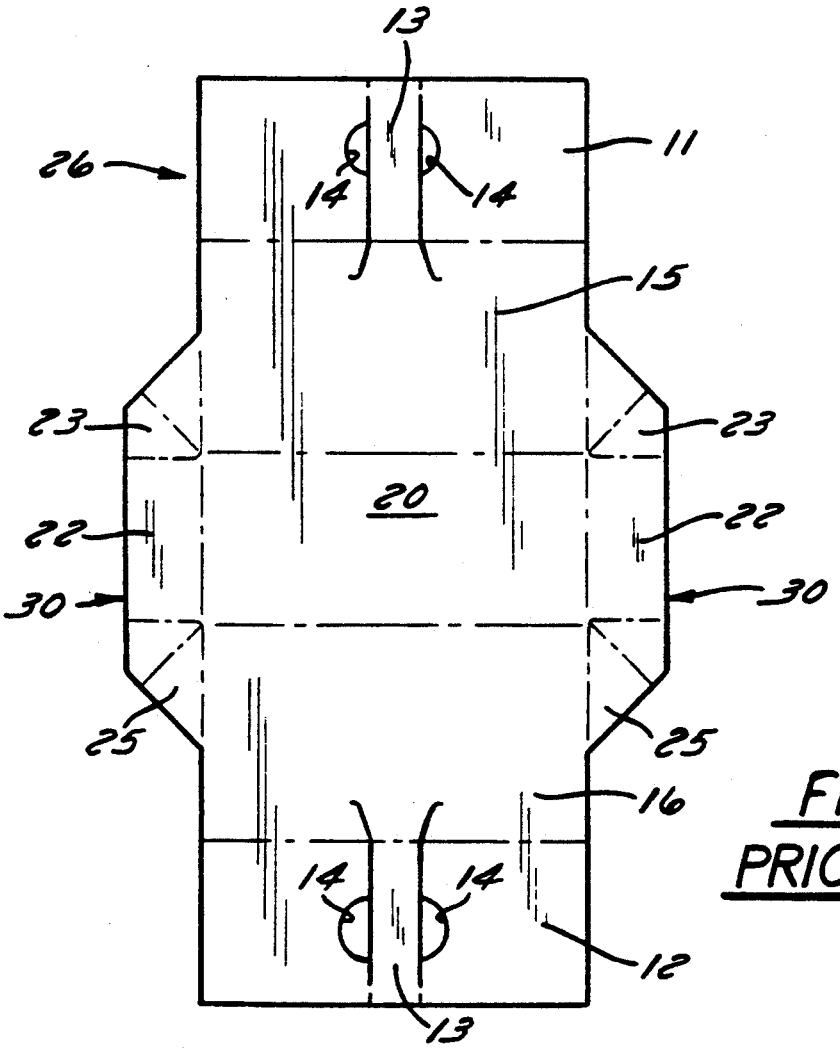
FIG. 2 PRIOR ART
FIG. 2 is a plan view of the production blank used for constructing the carton of FIG. 1.

FIG. 2 is the blank 26 shown in the aforementioned Schuster patent. Partial end panels 22 are shown along with tuck flaps 23 and 25. These components will not be described in detail as they are described in the aforementioned patent, but it should be understood that the score lines used to permit folding of the end panel to a vertical position are offset from the score lines between bottom 20 and side walls 15 and 16, thereby insuring an inward bow of end panels 22 when the carton is assembled. It is also readily apparent from a review of blank 26 that it includes a central, elongate rectangular section 29 and a pair of outwardly extending sections 30 on either side thereof. Sections 30 will, during manufacture of the Schuster device, be scored to provide the partial end panels 22 as described earlier herein. By reference to FIG. 2, it should also be appreciated that such sections must be formed from an initial blank larger than blank 26.

Figure 3:
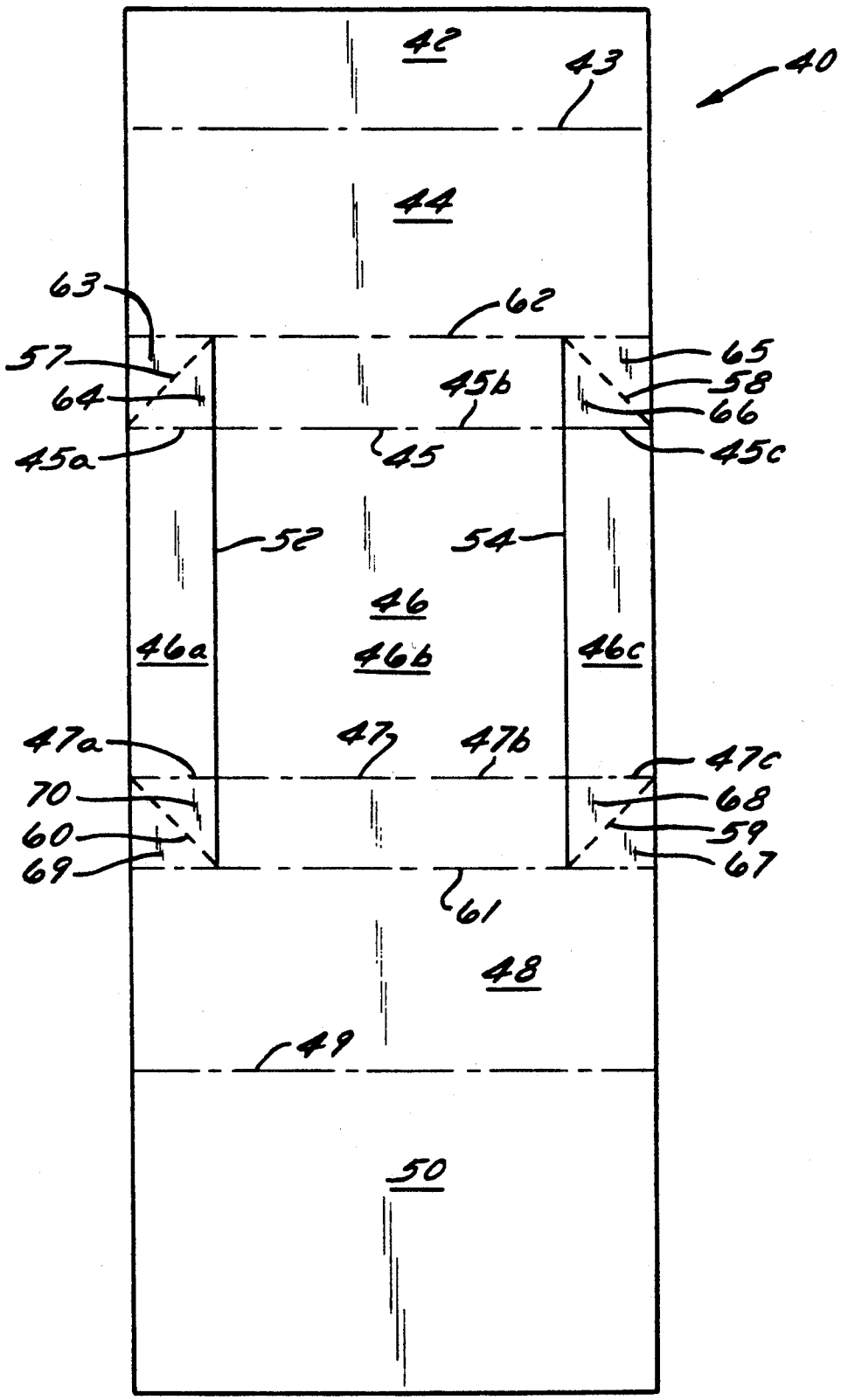
FIG. 3 is a plan view of the production blank for the carton of the most preferred form of the present invention.

Proceeding next to a description of FIG. 3, the blank 40 used to make the carton of the present invention is illustrated. Note that it is rectangular in shape and includes a plurality of score lines and cut lines which will each be described in the following paragraphs. FIG. 3 is oriented so that the long dimension extends from the top to the bottom of the sheet of drawings, and the description of blank 40 will proceed from the top toward the bottom, as shown in the illustration. Blank 40 includes at one end an inner, partial-width, full-length top panel 42, hingedly joined to a first side panel 44 by score line 43. A bottom panel 46 comprised of individual segments **46*a*, 46*b* and 46*c* is joined to side panel 44 along a score line 45 which has, similarly, three components 45*a*, 45*b* and 45*c*. Bottom panel 46*b* is centrally located between the other two bottom panel portions and is less than full length. Bottom panels 46*a* and 46*c*, in the preferred form of the invention, are of equal width and extend to the outer edge of blank 40. Bottom panel 46 is hingedly secured to a second side panel 48 along score line 47 consisting of three portions 47*a*, 47*b* and 47*c* and side panel 48 is in turn coupled to a full-width, full-length top panel 50 along score line 49**.

A pair of cut lines 52 and 54 extend parallel to each other and to the sides of blank 40 from points within side panel 44 to points within side panel 48, thereby creating the three segments of bottom panel 46, as well as segmenting the score lines 45 and 47. In the illustrated embodiment, cut lines 52 and 54 extend into the side panels by a distance which is approximately equal to the width of bottom panel portions **46*a* and 46*c***.

The next elements of blank 40 are four tuck score lines 57-60 which are located in a clockwise orientation about bottom panel **46*b*. Each extends from the end of a cut line (52 or 54) toward the nearest intersection of respective score lines 45*a*, 45*c*, 47*c* and 47*a* and the sides of the blank 40. For ease of assembly, and not a required feature of the invention, two additional score lines 62 an 61 are provided. Score line 62 extends across blank 40, is parallel to score line 45 and is located at the ends of the cut lines 52 and 54 in side panel 44. Similarly, score line 61 extends across side panel 48 at the ends of cut lines 52 and 54**.

Before proceeding to illustrations showing how blank 40 is assembled into a finished carton, it will be useful to number the eight triangular tuck flap areas in a clockwise manner beginning with the two tuck flap components on either side of tuck flap score line 57. The odd numbered areas 63, 65, 67 and 69 are those which include a side panel edge and a side edge, while the even numbered portions 64, 66, 68 and 70 are those triangular portions which include, on one edge, a cut line 52 or 54.

Figure 4:
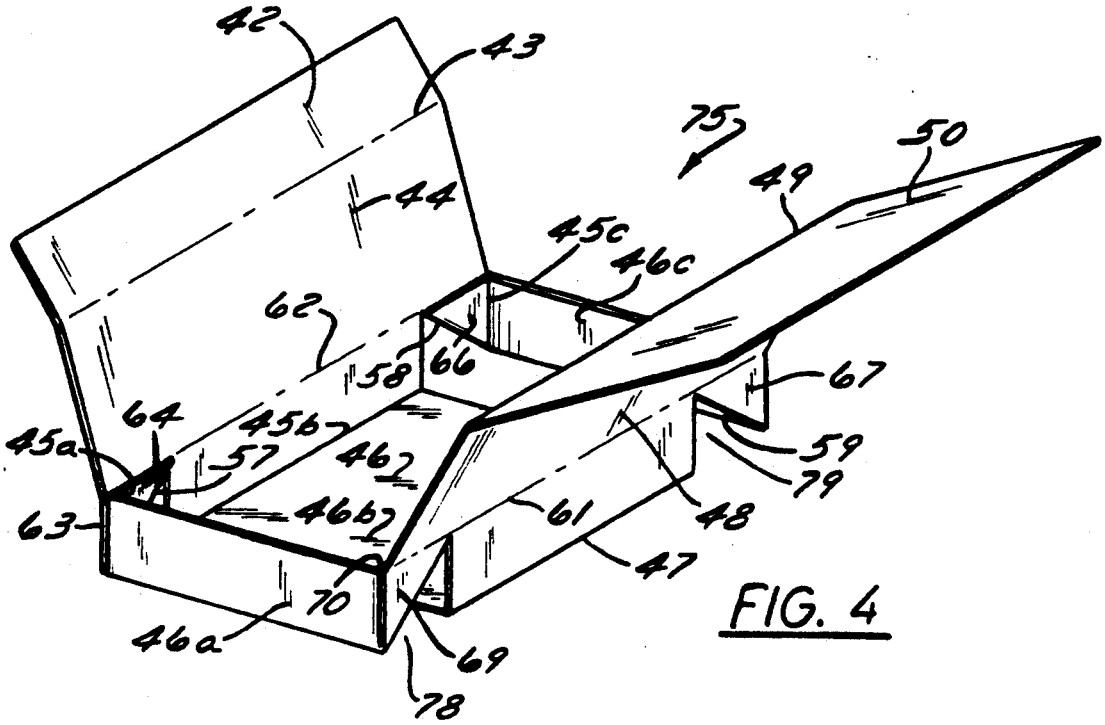
FIG. 4 is a perspective view showing the blank of FIG. 3 in a partially assembled condition.

Proceeding now to FIG. 4, a partially assembled carton 75 is shown. The lower portions of side panels 44 and 48 have been folded to a position perpendicular to bottom panel **46*b* along respective score lines 45 and 47. At the same time, the bottom panels 46*a* and 46*b* have been folded upwardly and outwardly about tuck score lines 57–60, thereby presenting four pairs of adjoining, triangularly shaped tuck flap portions, namely portions 63–64, 65–66, 67–68 and 69–70. These adjoining portions are preferably joined to one another by adhesive to securely maintain the side panels 44 and 48 in a perpendicular orientation with respect to end panel 46*b*. It is also to be appreciated in this figure that bottom panel 46*b* does not extend along the entire length of carton 75, but rather a pair of openings 78 and 79 are formed on either end. It will also be appreciated by reference to FIG. 5 that when top panel 42 is folded inwardly so that it is parallel to bottom panel 46 and top panel 50 is folded inwardly so that it is parallel to bottom panel 46 and overlies panel 42, the carton may be completed by adhering the front surface of panel 50 (as shown in FIG. 3) to the rear surface of panel 42**.

Figure 6:
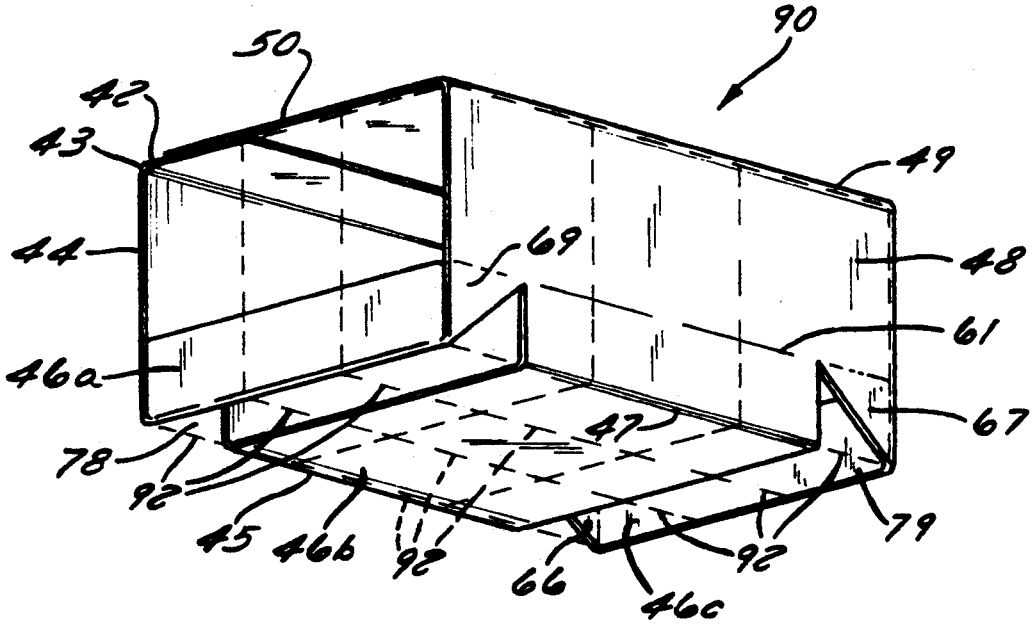
FIG. 6 is a partial perspective view taken from below the assembled carton and illustrating, in phantom lines, cartons, such as juice cartons, contained therein and illustrating in particular the partial support for the bottom of the primary packaging.

FIG. 6 shows a different perspective view of the completed carton 90 showing in phantom lines a plurality of juice containers 92 held therewithin and showing more clearly the relationship of the containers 92 and openings 78–79.

In practice, it is envisioned that the rectangular receiving area formed by bottom panel **46*b*, the side panels 44 and 48 and the partial end panels 46*a* and 46*b* would receive a grouping of such containers, after which panel 42 would be folded over the top thereof. Final assembly would be completed by applying a glue line to the reverse side of panel 42 (as shown in FIG. 3) and pressing top panel 50** thereover.

In a preferred method of assembly, however, the containers will be placed on bottom panel **46*b* with only the lower portions of side panels 44 and 48 perpendicular to panel 46*b*. This assembly technique is facilitated by the score lines 62 and 61 referred to in the description of FIG. 3. Final completion of the carton is then accomplished by folding side panels 44 and 48 along the sides of the juice carton and closing the top using panels 42 and 50** as previously disclosed.

Various modifications may be made to the carton without departing from the intended scope. For example, top flap 42 could be eliminated and panel 50 extended slightly in length with an additional score line whereby closure is completed by folding panel 50 across the top of the entire articles and folding the exterior downwardly along the rear surface of side panel 44 to effect closure. Modifications may be made to the width of panels **46*a* and 46*c*, depending upon the characteristics of the package with which the carton of the present invention is to be used. If smaller packages, for example raisin boxes, were to be packaged, the panels would be thinner so that openings 78 and 79** would not permit any primary package to work its way through the opening.

Other modifications, such as the use of various types of folding carton stock and printing thereof, would certainly be routine once the concept of the twist out and up end partial end panels was understood by the skilled artisan.

What is claimed is:

1. A blank for forming a carton, said blank being rectangular and having end edges defining the length of the carton, side edges and comprising:

a first full-length top panel at one end edge of the blank;

a first full-length, full-height side panel joined to the first end panel by a first score line;

a full-length, full width bottom panel area comprising a pair of end panels and a bottom panel located therebetween, the bottom panel area being joined to the first full-length side panel by a second score line;

a second full-length, full-height side panel joined to the bottom panel area by a third score line;

a second full-length top panel at the other end edge of the blank joined to the second side panel by a fourth score line;

a pair of cut lines parallel to the side edges of the blank and extending from within the first side panel to within the second side panel;

tuck flap score lines extending from the ends of the cut lines to the intersection of the nearest one of the second or third score line and the nearest side edges forming four pairs of adjacent triangular tuck flaps; and wherein fifth and sixth score lines are provided extending between the side edges of the blank and perpendicular thereto and located respectively in the first and second side panels at the ends of the cut lines.

2. The blank of claim 1 wherein the distance between the second and fifth score lines and between the third and sixth score line is about equal to the distance between the cut lines and their closest side edges.

3. The blank of claim 1 wherein the first top panel is a partial-width top panel.

4. A method of assembling the carton of claim 1 comprising the steps of folding the side panels to a position in which they are perpendicular to the bottom panel and twisting the end panels to a position wherein they lie in a plane generally perpendicular to the plane of the bottom panel, adhering the confronting surfaces of each pair of tuck flaps, and then adhering the first top panel to the first top panel.

5. The method of claim 4 comprising the additional step of inserting a plurality of packages into the carton prior to the top adhering step.

6. A method of assembling the carton of claim 1 comprising the steps of folding those portions of the first and second side panels between the second and fifth score lines and between the third and sixth score lines to a position on which they are perpendicular to the bottom panel and twisting the end panels to a position wherein they lie in a plane generally perpendicular to the plane of the bottom panel, adhering the confronting surfaces of each pair of tuck flaps, and then adhering the first top panel to the first top panel.

7. The method of claim 6 comprising the additional step of inserting a plurality of packages into the carton prior to the top adhering step.

* * * * *